United States Patent [19]

Puhak

[11] 4,362,963

[45] Dec. 7, 1982

[54] STRENGTHENED CRT APERTURE MASK FRAME

[75] Inventor: Peter G. Puhak, Seneca Falls, N.Y.

[73] Assignee: North American Philips Consumer Electronics Corp., New York, N.Y.

[21] Appl. No.: 241,176

[22] Filed: Mar. 6, 1981

[51] Int. Cl.[3] ..... H01J 29/07

[52] U.S. Cl. ..... 313/407

[58] Field of Search ..... 313/407

[56] References Cited

U.S. PATENT DOCUMENTS 3,737,703 6/1973 Tsuneta et al. ..... 313/407

4,099,086 7/1978 Roder et al. ..... 313/407

*Primary Examiner*—Palmer C. Demeo

*Attorney, Agent, or Firm*—Thomas A. Briody; Jack Oisher; John C. Fox

[57] ABSTRACT

The invention provides improved strengthening means for the inherently weak corner regions of the framing member of a rectangular color CRT aperture mask-frame assembly. The improved means are in the form of crescent-shaped indentations discretely positioned to add strength to the corner material by substantially following the natural flow of the material thereat. The termini of the crescents are rounded and tapered to minimize stress concentrations in the regions.

6 Claims, 5 Drawing Figures

STRENGTHENED CRT APERTURE MASK FRAME

TECHNICAL FIELD

This invention relates to the perimetrical framing member of a CRT substantially rectangular aperture mask-frame assembly and more particularly to means for strengthening the corner regions thereof.

BACKGROUND OF THE INVENTION

In multibeam color cathode ray tubes (CRTs), it is conventional practice to employ an aperture mask-frame assembly which is suitably supported within the envelope in spaced relationship to an adjacent patterned cathodoluminescent screen formed on the interior surface of the tube viewing panel. Common types of patterned screens utilized with the abovementioned mask may be comprised of a multitude of dot triads or stripes of different color emitting phosphors disposed on the panel in a predetermined sequence in related registry with the apertures or openings in the foraminous mask. The alignment relationship of the mask openings with the elements of the screen pattern is a requisite for subsequent phosphor excitation by specific electron beams directed thereto. The term "aperture" as used herein is given a broad connotation including those that are substantially round, ovate, or slot-like openings.

The apertured portion of the mask-frame assembly is a delicately domed structure of thin gauge material which is affixed to a substantially rigid metallic perimetrical supporting or framing member. This essential supporting member is usually a one-piece drawn structure representing an integration of top, bottom and side elements transitionally combined at angular corner regions to provide continuous perimetrical support. The peripheral structure of this framing member manifests a substantially L-shaped cross-sectional configuration evidencing a ledge portion instanding from an edge-related upstanding sidewall portion. The terminal contour of the sidewall portion is shaped to mate with the domed apertured portion which is bonded thereto to complete the mask-frame assembly. This assembly is then positioned, by a plurality of support means, within the tube viewing panel in close proximity to the patterned cathodoluminescent screen disposed therein.

By the inherent constructional shaping of the framing member, structurally weaker areas occur in the corner regions because of the designed reduction of material in those areas and the drawn shaping which tends to reduce the material thickness thereat. Thus, as a resultant of these weakening factors, the stresses induced by the drawing procedure often impart a slight twist or warpage influence to the corner regions. When the domed apertured portion is affixed to the framing member, in the mask-to-frame assembly procedure, mechanical jigging is utilized to seat the frame into a flat position prior to consummation of the bonding. But, when the mask-frame assembly is subsequently lehr heated during the panel-to-funnel sealing operation, the constraining influences of the mask apertured portion are lessened, whereupon the stressing forces in the framing member tend to again assume prominence and produce the undesirable corner-oriented twisting action. Any warpage of the mask assembly within the tube causes mis-alignment of the mask apertures with the respective elements of the patterned screen, thereby deleteriously affecting both resolution and color purity of the screen display.

Prior art techniques to overcome the aforementioned twisting action included the incorporation of straight strength ribs in the corner regions, being oriented substantially tangent and perpendicular to a diagonal bisector therethrough. Being so positioned, this straight type of rib cut across the flow lines of the corner material. In addition, the usual deep shaping of the ends of such ribs tended to unduly stretch the material in the corners, thereby introducing additional stresses which, in themselves, tended to aggravate warpage when released during tube processing.

DISCLOSURE OF THE INVENTION

It is therefore an object of the invention to reduce and obviate the aforementioned disadvantages evidenced in the prior art. Another object of the invention is the provision of an improved means for strengthening the corner regions of the framing member of a CRT aperture mask-frame assembly without inducing undue stress therein. A further object of the invention is to achieve greater frame rigidity and a resultant consistency of improved tube quality.

These and other objects and advantages are accomplished in one aspect of the invention by providing each corner region of the mask framing member with a substantially crescent-shaped indentation formed in the ledge portion of the frame. These strengthening crescent-shaped indentations are oriented in a substantially symmetrical manner in the corner regions with the open concave edges facing the central opening delineated by the frame. Structurally, each of the respective crescent shapings exhibits rounded and sloped termini which are proven augmentative features of the indent. The circular shaping of each crescent formation and the discrete orientation thereof permits usage of a longer strengthening indentation than evidenced in the prior art, and one that is inherently stronger because of its shape.

BEST MODE FOR CARRYING OUT THE INVENTION

For a better understanding of the present invention together with other and further objects, advantages and capabilities thereof, reference is made to the following disclosure and appended claims taken in conjunction with the aforedescribed drawings.

Figure 1:
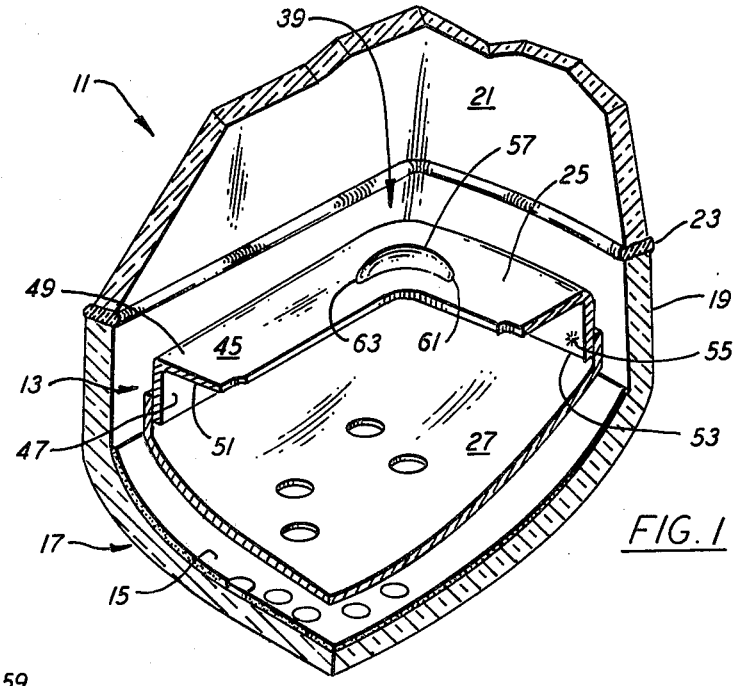
FIG. 1 is a partial sectional perspective view of a color cathode ray tube showing the orientation of the invention.

With reference to the drawings, there is shown in FIG. 1 a partially sectioned portion of a conventional color cathode ray tube 11 of the type employing a substantially rectangular multi-opening mask-frame assembly 13, such being spatially related to a patterned cathodoluminescent screen 15 disposed upon the interior surface of the tube viewing panel 17.

In greater detail, the mask-frame assembly 13, which is spacedly positioned within the viewing panel portion 17 of the tube envelope, is suitably supported therein relative to the panel sidewall 19 by means not shown. The panel with the mask-frame assembly positioned therein, is hermetically joined with the tube envelope funnel portion 21 by frit sealing means 23 to complete the tube construction as illustrated in FIG. 1.

The mask-frame assembly 13 is comprised of a metallic framing member 25, fabricated, for example of substantially 0.045 inch (1.14 mm.) cold rolled steel, to which is attached the substantially domed multi-apertured portion 27. While the apertured mask portion is shown to have substantially circular openings therein, such is not limiting as the openings may also be of ovate or elongated slot-like shapings in keeping with the associated screen pattern desired.

Figure 5:
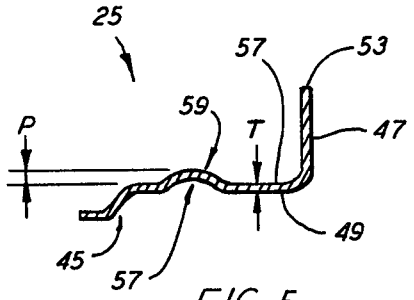
FIG. 5 is a cross-sectional view of the framing member taken along the line 5—5 in FIG. 4.

As illustrated in the drawings, the substantially rectangular framing member 25 is formed of an integration of top 29, bottom 31 and side 33, 35 elements transitionally combined, at angular corner regions 37, 39, 41 and 43, to provide a continuous perimetrical supporting structure for the assembly 13. From a central point of origin O, reference axes X-X' and Y-Y' are provided in the plane of the framing member as indicated. Cross-sectionally, the framing member is of a substantially L-shaped configuration exhibiting a substantially formed ledge portion 45 which is instanding from an integral edge-related perimetrical upstanding sidewall portion 47. The ledge portion has an exterior surface 49 and an interior surface 51 from which the sidewall portion 47 is in substantially perpendicular relationship, as shown in FIGS. 1 and 5. The sidewall portion is terminally contoured 53 to mate with the peripheral shaping of the apertured mask member 27, which is subsequently positioned thereupon and affixed thereto as by the application of a multiplicity of welds 55 therearound.

Figure 2:
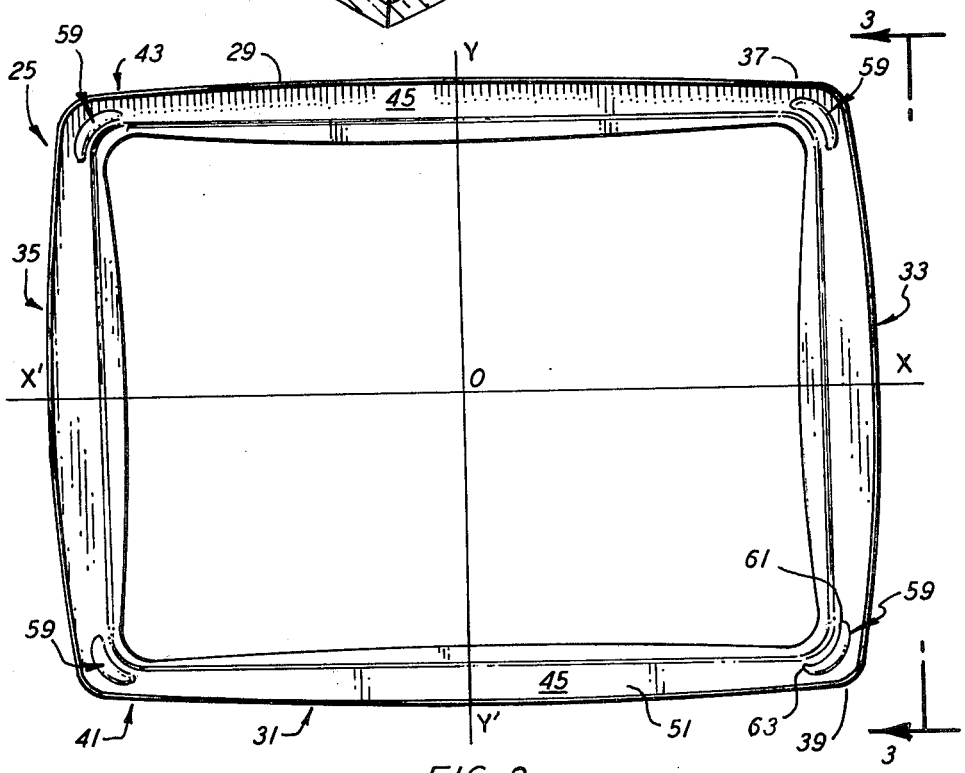
FIG. 2 is a plan view of the rectangular perimetrical framing member subsequentially utilized in the CRT mask-frame assembly.
Figure 3:
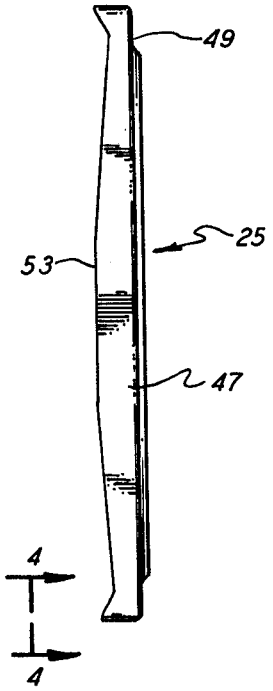
FIG. 3 is an end view of the framing member taken along the line 3—3 in FIG. 2.

As evidenced in FIGS. 2 and 3, the inherent constructional shapings of both the ledges 45 and sidewall 47 portions of the framing member produces a designed reduction of material in the corner regions 37, 39, 41 and 43. This reduction of material and the drawn shaping of the member conjunctively produce corner regions that are structurally weaker than the other areas of the frame. As previously mentioned, the material stresses induced by the fabrication drawing procedures often impart a twisting or warping influence to the vulnerable corner regions.

The invention is directed to the incorporation of discrete means in the respective corner regions to markedly strengthen and augment the rigidity thereof. Such strengthening means is in the form of a substantially crescent-shaped indentation 57, one of which is oriented in each of the angular corner regions of the ledge portion 45 of the framing member. As shown, the indentation 57 is formed inward from the exterior surface 49 of the ledge portion, thereby producing a complementary protrusion 59 from the interior surface 51. But, if desired, it can be formed outward from the interior surface 51, whereupon a complementary protrusion will be evidenced on the exterior surface 49. As illustrated in FIG. 5, the indentation 57 is of substantially arcuate cross-section, being free of any angular manifestations. The projection of the complementary protrusion 59 from the interior surface 51 is represented by the dimension "P" which slightly exceeds the thickness "T" of the ledge material. Such dimensional relationship provides a construction of adequate strength. It is to be noted in FIGS. 1, 2 and 4 that the termini 61 and 63 of the crescent shaping are rounded with tapering or sloping of the indentation thereat. It has been found that such construction beneficially minimizes the concentration of material stresses in the termini areas.

Figure 4:
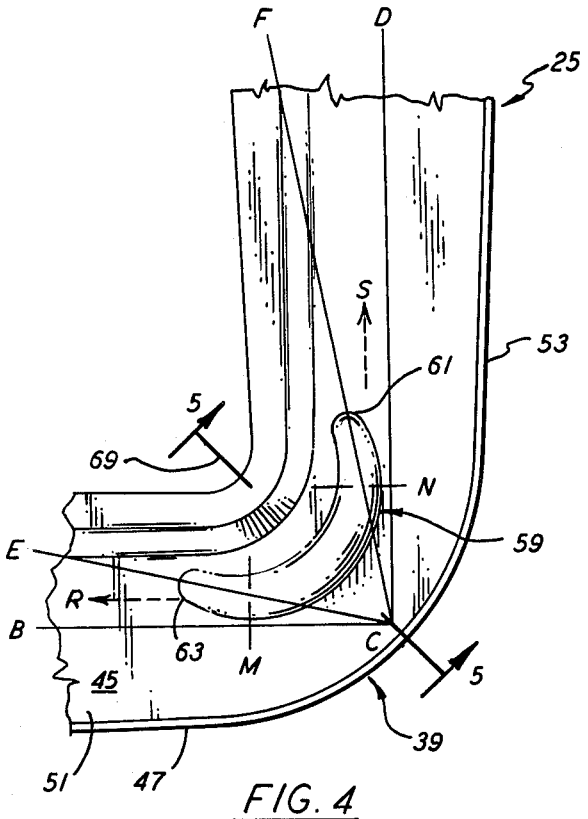
FIG. 4 is an enlarged view of a corner section of the framing member in the area designated by line 4—4 in FIG. 3.

As particularly shown in FIGS. 2 and 4, each of the crescent shapings, having concave 65 and convex 67 edges, is oriented in a substantially symmetrical manner in each of the respective corner regions, with the concave edge 65 facing the origin "O" of the X-Y reference axes. As such, the bisector 69 of the corner region 39 is substantially the bisector of the respective crescent shaping 59 associated therewith.

The constructional form of a representative crescent shaping 59 with reference to its advantageous positioning in an exemplary substantially rectangular corner region 39 is delineated in FIG. 4. The angle ∠BCD is a general right angular representation of the corner region 39 of the framing member 25. In relationship therewith, the arcuate length of the crescent shaping 59 is such that the directional curvatures of the termini regions 61 and 63 delineate a substantially acute angle ∠ECF. It is thought by this relationship, the major portion of the indentation, from about region "M" to region "N" thereof, substantially follows the substantially predominant flow of corner material, thereby adding strength without undue stress. In the termini regions 63 and 61, beyond "M" and "N" respectively, the end curvatures of the indentation are such as to effect slight diagonal intersections of the substantially predominant natural flows of material. Such intersections are considered to augment rigidity while contributing minimal stress to the fabrication. The framing member incorporating such crescent-shaped indentations has been found to exhibit markedly strengthened corner regions.

INDUSTRIAL APPLICABILITY

The strenghtening means of the invention incorporated into the corner regions of the framing member of a substantially rectangular color CRT mask-frame assembly adds beneficial rigidity and stability to the structure. The crescent-shaped indentations, having rounded and tapered termini, are corner-oriented in a manner to substantially follow the natural flow lines in the drawn frame material. The grain or lattice structure is not disturbed in an unnatural manner. The formation of the indentations is readily adaptable to mask frame fabrication, the additional cost being more than offset by improved tube quality.

What is claimed:

1. An improvement in the metallic perimetrical framing member of a substantially rectangular aperture mask-frame assembly of the type positioned in a color cathode ray tube in spaced relationship within the viewing panel adjacent the cathodoluminescent screen disposed thereon; said framing member being an integration of top, bottom and side elements transitionally combined at angular corner regions to provide a continuous perimetrical supporting structure having X and Y axes of reference therethrough; said member evidencing a substantially L-shaped cross-sectional configuration having a substantially formed ledge portion instanding from an integral edge-related perimetrical upstanding sidewall portion, said ledge portion evidencing an exterior surface and an interior surface from which said sidewall portion is in substantially perpendicular relationship; said sidewall having a terminal contour whereupon the apertured mask member of said mask-frame assembly is subsequently positioned and affixed, said improvement being means for strengthening the angular corner regions of said framing member and comprising:

a substantially crescent-shaped indentation, having concave and convex edges and rounded termini, formed in said ledge portion at each of said corner regions; each of said crescent shapings being oriented with said concave edge thereof facing the origin of said axes; and whereof a bisector of each of said corner regions is substantially a bisector of the respective crescent shaping associated therewith.

2. The improvement in the framing member of the CRT mask-frame assembly according to claim 1 wherein each of said crescent-shaped indentations is of substantially arcuate cross-section and evidences sloping termini regions.

3. The improvement in the framing member of the CRT mask-frame assembly according to claim 1 wherein each of said crescent-shaped indentations produces a complementary protrusion from the opposed surface that slightly exceeds the thickness of the ledge material.

4. The improvement in the framing member of the CRT mask-frame assembly according to claim 1 wherein each of said crescent-shaped indentations is formed inward from the exterior surface of said ledge portion.

5. The improvement in the framing member of the CRT mask-frame assembly according to claim 1 wherein each of said crescent-shaped indentations is formed outward from the interior surface of said ledge portion.

6. The improvement in the framing member of the CRT mask-frame assembly according to claim 1 wherein the directional curvatures of the termini regions of each crescent shaping delineate a substantially acute angle with reference to the general right angular representation of the respective corner region of the framing member.

* * * * *